United States Patent [19]

Fischer

[11] 4,393,653

[45] Jul. 19, 1983

[54] RECIPROCATING EXTERNAL COMBUSTION ENGINE

[75] Inventor: Victor H. Fischer, Artarmon, Australia

[73] Assignee: Thermal Systems Limited, Grand Cayman, British West Indies

[21] Appl. No.: 215,867

[22] Filed: Dec. 12, 1980

[30] Foreign Application Priority Data

Jul. 16, 1980 [AU] Australia ..... PE4554

[51] Int. Cl.[3] ..... F01K 21/04

[52] U.S. Cl. ..... 60/511; 60/514

[58] Field of Search ..... 60/508, 511, 512, 514, 60/650, 682, 674; 122/249

[56] References Cited

U.S. PATENT DOCUMENTS

| | | | |
|---|---|---|---|
| 1,746,158 | 2/1930 | Loffler | 122/249 |
| 2,217,192 | 10/1940 | Wuehr | 60/514 |
| 3,192,705 | 7/1965 | Miller | 60/511 |
| 3,336,746 | 8/1967 | Southwick | 60/514 |
| 3,878,680 | 4/1975 | Dauvergne | 60/511 |
| 3,972,194 | 8/1976 | Eskeli | 60/650 |
| 4,016,724 | 4/1977 | Karlsson | 60/672 |
| 4,077,214 | 3/1978 | Burke | 60/512 |

FOREIGN PATENT DOCUMENTS

| | | | |
|---|---|---|---|
| 2325279 | 1/1975 | Fed. Rep. of Germany . | |
| 2329020 | 1/1975 | Fed. Rep. of Germany . | |
| 2364930 | 7/1975 | Fed. Rep. of Germany . | |
| 2416964 | 10/1975 | Fed. Rep. of Germany . | |
| 2750925 | 5/1979 | Fed. Rep. of Germany . | |
| 13912 | of 1891 | United Kingdom | 60/674 |
| 438551 | 11/1935 | United Kingdom . | |
| 1081499 | 8/1967 | United Kingdom . | |
| 1352510 | 5/1974 | United Kingdom . | |
| 1531492 | 11/1978 | United Kingdom . | |

*Primary Examiner*—Allen M. Ostrager
*Assistant Examiner*—Stephen F. Husar
*Attorney, Agent, or Firm*—Bernard, Rothwell & Brown

[57] ABSTRACT

A reciprocating external combustion engine wherein energy is transferred to air acting as a working gas by injection into the air of liquid water at a high temperature and pressure. The liquid water is injected either directly into the cylinder or into a preliminary mixing chamber. The water acts as a heat-transfer medium for heating the air. Spontaneous vaporization of the liquid water on injection increases the pressure of the air which drives the piston before being exhausted. The exhaust water is recovered and recycled. The cylinder is scavenged and refilled with a fresh charge of air.

25 Claims, 11 Drawing Figures

RECIPROCATING EXTERNAL COMBUSTION ENGINE

The present invention relates to a reciprocating external combustion engine, i.e., an engine of the type having a cylinder or cylinders whose reciprocating motion provides a source of power and wherein the heat powering the cylinder is generated externally of the cylinder. In particular, the invention provides a novel operating cycle.

Many attempts have been made to produce an engine which combines high thermal efficiency in terms of converting applied heat energy into useful work, with acceptable power to weight and power to volume ratios for the engine. The internal combustion engine has a good power to weight ratio but a relatively low thermal efficiency. The diesel engine has the best thermal efficiency (up to around 40 percent). Thermodynamically more efficient engines based on the Carnot, Stirling and Ericsson cycles have been built but these have not in general been commercial successes, largely on account of theproblem of providing a small and efficient heat exchanger enabling the working gas to become quickly and efficiently heated by the external heat source.

The steam engine is a well known form of external combustion engine but its power to weight ratio is generally low, owing to its requiring a separate steam boiler and condenser. The steam engine generally uses dried steam or other dry vapor as the working fluid. However, the present invention is not concerned with such an engine but is concerned with an external combustion engine which uses a gas such as air as the working fluid.

Thus, the present invention provides a reciprocating external combustion engine wherein energy is transferred to a working gas from a heated liquid heat-transfer medium, which comprises a cylinder having a piston reciprocatable therein and defining a working end space;

a heat exchanger for heating the heat transfer medium externally of the cylinder under a pressure such as to maintain the medium in the liquid state;

induction means for inducting gas into the working end space;

an injector arranged to inject heated liquid medium into the gas before or after the gas is inducted into the end space;

the cylinder having an outlet controlled to exhaust heat transfer medium from the working end space near the end of an expansion stroke of the piston.

The external combustion engine of the present invention includes a cylinder which may comprise a single double-acting cylinder having a piston therein defining on one side of the piston (usually the rod-end side) a compressor end space and on the other side of the piston the working end space, as in a two-stroke engine. However, this would not preclude the use of mechanical equivalents to this arrangement, for example the use of two cylinders coupled to a common shaft, one of the cylinders providing by its piston the compressor end space and the other cylinder providing with its separate piston the working end space. The engine may also be arranged to work according to a four-stroke cycle wherein one stroke is an induction stroke. The compression ratio employed may vary widely depending on the particular application of the engine. Thus, in some applications a compression ratio as low as 1.5:1 or perhaps lower may be employed and in other applications, the ratio may be as high as 20:1.

The engine might alternatively comprise a pair of opposed pistons reciprocatable within a common cylinder, such that the two piston crowns and the cylinder wall define the working end space.

Means are provided for inducting gas into each working space. In its simplest form the inducting means may be a ram together with an inlet port into the working space for scavenging the exhaust gas and replacing it with a fresh gas charge, usually around bottom dead center. Alternatively, a compressor may be provided to feed compressed gas to the working space. In a two-stroke engine the compressor may be provided by the compressor end space of the cylinder. However, a separate rotary or reciprocating compressor might be provided, such as a vane or turbine compressor. In a four-stroke engine the induction stroke serves to induct the gas.

Various inlet and outlet valves of conventional construction are provided as necessary, and may be in the form of check valves or may be driven by means of a cam operated by the engine. However, this would not preclude the absence of valves, for example, the piston may be arranged to open and close inlet and outlet ports as in a two-stroke engine.

An injector is also provided for injecting preheated liquid heat-transfer medium into the gas. The purpose of the injected liquid medium is to enable heat transfer from the heat exchanger to the gas to be achieved efficiently. Thus, very much smaller heat exchanger surfaces are required in order to heat a given weight of liquid in comparison to the surface area required to heat the same mass of gas. Consequently, the present invention envisages heating the medium in the liquid stage and allowing the gas to become heated by contact with the hot liquid medium.

The heat-transfer medium may be one which vaporizes or does not vaporize under the engine working conditions, after injecting into the working gas. A non-vaporizing liquid will generally be introduced into the working space in the form of droplets having a high surface area. A vaporizing liquid may evaporate at least partially to form a vapor thereby enabling extremely good heat transfer to be achieved between the hot vapor derived from the heat-transfer medium and the working gas. The liquid heat-transfer medium may be injected into the gas before or after the gas is inducted into the working space. If the heat-transfer medium is not vaporizable it is preferably sprayed into the gas in the form of droplets. When a vaporizable medium is used, it may vaporize completely after injection or vaporize incompletely. Although the liquid medium may be injected into unpressurized working gas, it is well known that greater thermal efficiency is achieved by injecting the liquid medium into the compressed gas.

To avoid confusion the following terms as used herein will be clarified. The working gas into which liquid medium has been injected will be referred to generally as wet gas. Gas into which liquid medium has not been injected will be referred to as dry gas. The injected heat-transfer medium may be present in the gas in its liquid or vapor state.

The heating of the liquid heat-transfer medium and its injection into the working gas may be achieved in a variety of different ways. Generally, the heat exchanger comprises a fuel-burner for heating the liquid medium.

Firstly, the liquid may be heated in a compact heat exchanger, for example a coil of narrow bore tubing, to a high pressure and high temperature (i.e., to a high internal energy). Since such narrow bore tubing can withstand great pressures, it is usually possible to heat the liquid up to its critical point. For special applications where the rate of heat transfer is to be high, it may be preferred to heat the medium to a temperature and pressure above its critical point. The hot pressurized liquid medium is then injected into the gas in a mixing chamber. A non-vaporizing liquid medium is preferably injected by means of an atomizing injector. Internal energy of the medium is rapidly transferred from the hot liquid droplets to the gas, thereby increasing its pressure. The heated and pressurized wet gas is then fed into the working end space of the cylinder where it expands (usually polytropically, i.e., non-adiabatically) to drive the piston.

However, in a second most advantageous arrangement, the mixing chamber is dispensed with and hot high pressure liquid medium which has been heated in the heat exchanger is injected directly into the working end space of the cylinder. Thus, a charge of scavenging gas is compressed to a pressure sufficient to enable it to be fed quickly into the working end space when the piston is near bottom dead center. Then, the dry scavenging gas is compressed adiabatically and so becomes heated as the piston travels towards top dead center. At close to top dead center the heated pressurized liquid medium is injected into the working end space, thereby causing the compressed gas pressure to increase still further and its expansion to drive the piston downwards again towards bottom dead center.

Heat transfer between the hot heat-transfer medium and the working gas is very rapid. As the piston approaches bottom dead center, the gas expands (usually polytropically) and becomes cooled causing the liquid or vapor to give up internal energy.

Preferably, the liquid is a vaporizable liquid, such as water, which at least partially flashes to vapor immediately it is injected into the working space. Thus, heat transfer between the hot water vapor and the working gas is very rapid.

Therefore, it may be seen that in this second arrangement the injected liquid medium is merely acting as a heat transfer fluid which may enable the compressed gas to convert internal energy to mechanical work. If a vaporizable medium is employed, the heat transfer process is particularly effective provided that most of the vapor leaves the cylinder in the liquid stage, so that latent heat of vaporization is not lost.

The present invention is to be distinguished from a steam engine in that the medium is maintained in its liquid form and not allowed to vaporize until it is introduced into the gas. This is in sharp contrast to a steam engine wherein, even if a flash boiler is used, the water is always introduced into the cylinder in the form of steam. In fact, since it is necessary to superheat the steam to remove water droplets in a conventional steam engine, it is not possible to directly flash liquid water into the cylinder of a steam engine since this would give rise to water droplets in the cylinder. However, in the engine according to the present invention, the presence of water droplets in the working space may be tolerated. Indeed, in some cases it may be desirable to construct the piston and/or cylinder so as to retain liquid medium in the working space after exhaust. Thus, the piston or cylinder may be provided with suitable recesses.

It is necessary that the heated medium be maintained in the liquid state prior to injection. Although this may be achieved by using appropriate sensors to ensure that the temperature at a given pressure never exceeds the liquid boiling point, it has been found that if an orifice of suitable size is connected to the heat exchanger in which the liquid medium is heated and a flow of liquid medium is maintained through the heat exchanger, then the application of heat to the medium does not cause the liquid to boil. Thus, by correct choice of orifice size, complex temperature and pressure sensing devices may be avoided. So long as the orifice provides a pressure drop, the pressure in the heat exchanger will at all times be such that, as the temperature is increased, the pressure of the water in the heat exchanger will also increase and thereby be always below the boiling point. The orifice normally forms part of the injection means through which the liquid medium is injected into the gas.

The rate of working of the engine may be controlled by any of several means. For example, it may be controlled by varying the amount of heat-transfer medium injected into the cylinder. The rate of working of the engine may be controlled by controlling the amount of heat supplied to the heating coil by the burner, for example, by controlling the fuel supply to the burner (for a constant liquid volume injection rate). The rate of working of the engine may also be controlled by controlling the rate of injection of liquid medium, e.g. by using a variable displacement pump.

Usually, the heat-transfer medium is recovered from the exhaust gas after the gas has been exhausted from the working space. The recovered medium which will still be somewhat heated, may be recycled again to the heat exchanger so that its internal energy is not lost. In this way, the medium acts merely has a heat transfer fluid and is not substantially used up.

Water is a preferred heat transfer fluid, not only because it is vaporizable, but also because it has a thermal conductivity which is high compared to the other liquids, for example heat transfer oils. Moreover, as will be explained later, means may be provided for recovering water produced by combustion in the burner. Thus, it may be possible to avoid any need for make-up water since this will be provided by water from combustion in the burner. Of course, it is possible to use other liquids, such as mercury, which has a thermal conductivity 10 times that of water, and sodium. However, mercury has other obvious disadvantages, such as cost and toxicity. When water is used an oil may be added to form a dispersion, emulsion or solution to assist lubrication of the engine.

In a particularly preferred embodiment of the present invention, the working gas is a gas which is capable of taking part in the combustion process which occurs in the burner. In this way, the internal energy of the gas exhausted from the cylinder is able to be recovered. The gas may be a gas capable of supporting combustion, such as oxygen, air or other oxygen-containing gas, or nitrous oxide. Alternatively, the gas may itself be a combustible gas chosen from all known combustible gasses, such as gaseous hydrocarbons, carbon monoxide, or hydrogen. Thus, some or all of the exhaust gas may be fed to the burner.

The fuel burnt in the burner itself may be chosen from known combustible fuels such as gasolines, fuel oils, liquefied or gaseous hydrocarbons, alcohols, wood, coal or coke.

It is in general preferred to use various heat recovery means. Thus, the whole engine may be enclosed in a heat insulating enclosure and be provided with heat exchangers to pick up stray heat and transfer it to, for example, the compressed gas or to preheat the fuel for the burner. It is also preferred to recover the heat remaining in the burner flue gases, and this may be achieved by passing the flue gases through a spray chamber in which a stream of liquid (generally the same liquid as that injected into the engine) is sprayed through the flue gas. When injection of a vaporizable liquid medium is employed, it is preferred that the vaporizable liquid be sprayed through the flue gases to heat the liquid medium close to its boiling point prior to being passed to the heat exchanger. Moreover, when water is employed as the injected heat-transfer medium, the use of water spray chamber or a condenser is advantageous in that water from the burner may be condensed out of the flue gases so that it is not necessary to provide make-up water to the engine.

The construction of an engine according to the present invention is considerably simplified in certain respects in comparison with known engines, such as internal combustion engines. Thus, the temperatures encountered in the working space are generally reduced, thereby simplifying sealing around the piston. It will be appreciated that power may be provided in the engine of the present invention at lower temperatures than, for example an internal combustion engine. Moreover, the internal combustion engine is less thermally efficient in that means must be provided to cool the cylinders and prevent seizing up.

Moreover, since the temperatures encountered in the engine are relatively low, for example up to 350° C., it is not usually necessary to construct the cylinder of metal. Plastics such as polytetrafluorethylene (PTFE), fiber-reinforced resins, and other plastics used in engineering, are particularly advantageous due to their cheapness and ease of use. Other heat insulating materials such as wood, concrete, glass or ceramics may also be used.

In a preferred embodiment, the hot liquid medium is injected into one end of the working end space and the inlet and outlet are at the other end of the piston stroke. The use of low conductivity plastics materials, allows the one end of the cylinder to be hot while the inlet and outlet region is relatively cool.

Power is taken from the engine by means of a piston rod attached to the reciprocating piston means. The free end of the piston rod may be connected to an eccentric shaft on a rotary fly wheel directly or by using a crankshaft so as to convert the reciprocating motion into a rotary motion.

Although the invention has been described in relation to an engine having a single cylinder, it will be appreciated that multicylinder engines of two or more cylinders will generally be preferred in practice. In a two-stroke engine there will in general be advantages in connecting the compressor end space of one cylinder so that it feeds the working end space of a different cylinder, thus enabling the compressed gas to be delivered at the most appropriate moment in the working cycle of a given cylinder.

The invention also relates to a method of operating a reciprocating external combustion engine, and to a kit of parts for converting an engine (e.g. an internal combustion engine such as a diesel engine) to an engine according to the present invention.

BRIEF DESCRIPTION OF THE DRAWINGS

Embodiments of the invention will now be described with reference to the accompanying drawings wherein.

DESCRIPTION OF THE PREFERRED EMBODIMENTS

Figure 1:
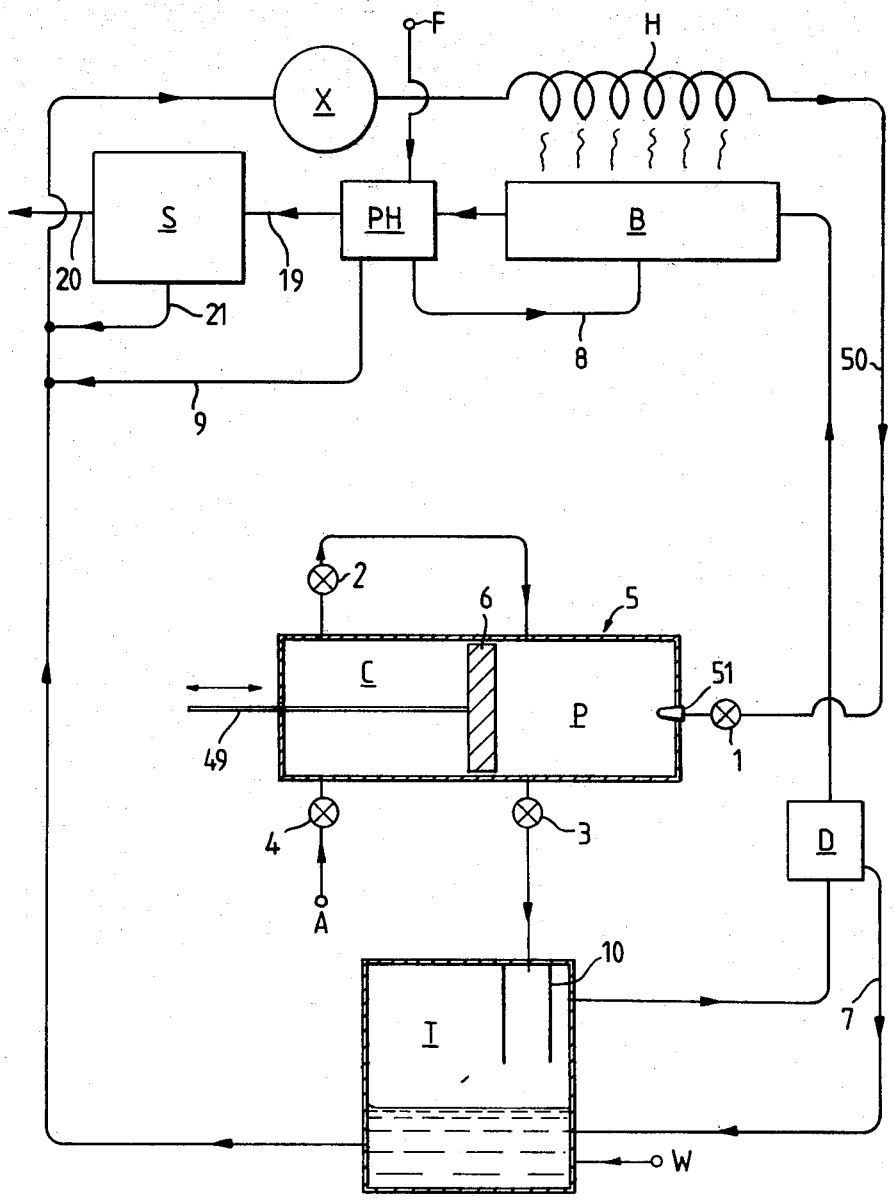
FIG. 1 is a schematic view of a first embodiment of external combustion engine according to the present invention.

In carrying out the invention, in one form thereof, as shown in FIG. 1, the external combustion engine comprises a cylinder 5 having piston 6 defining a compressor end space C and a working end space P, a heating coil H of a heat exchanger for heating liquid water under pressure by means of a burner B, an optional preheater PH for preheating fuel F for the burner by means of burner flue heat, a spray device S for cooling flue gas from the burner, pump X for feeding water under pressure to the heating coil, a trap T for recovering liquid water from the wet exhaust gas from the working space, and a gas dryer D for recovering liquid water from the combustion gas supplied to the burner.

The external combustion engine works in the following manner. Air A at atmospheric temperature and pressure is inducted into compressor end space C of the cylinder 5 by moving piston 6 to the right (as viewed in FIG. 1) and thereby opening inlet check valve 4. The outlet from the compressor end space C is closed by means of check valve 2. When the piston 6 has reached the extreme right of this travel (top dead center-TDC), inlet valve 4 closes. Continued movement of the reciprocating piston back towards the left causes the air to become compressed.

Compression is continued to provide a sufficient pressure of air in space C in order to efficiently scavenge exhaust gas from working space P when the compressed air is admitted to the working space P somewhat before BDC via inlet valve 2. Thus, as the piston approaches BDC outlet, valve 3 opens to release wet exhaust air, and shortly afterwards check valve 2 is opened to admit compressed and slightly heated air to scavenge and fill the working space P with dry air at substantially atmospheric pressure.

Shortly after BDC valves 2 and 3 are closed and as the piston moves toward TDC again, the dry air is compressed adiabatically and isoentropically.

Figure 7:
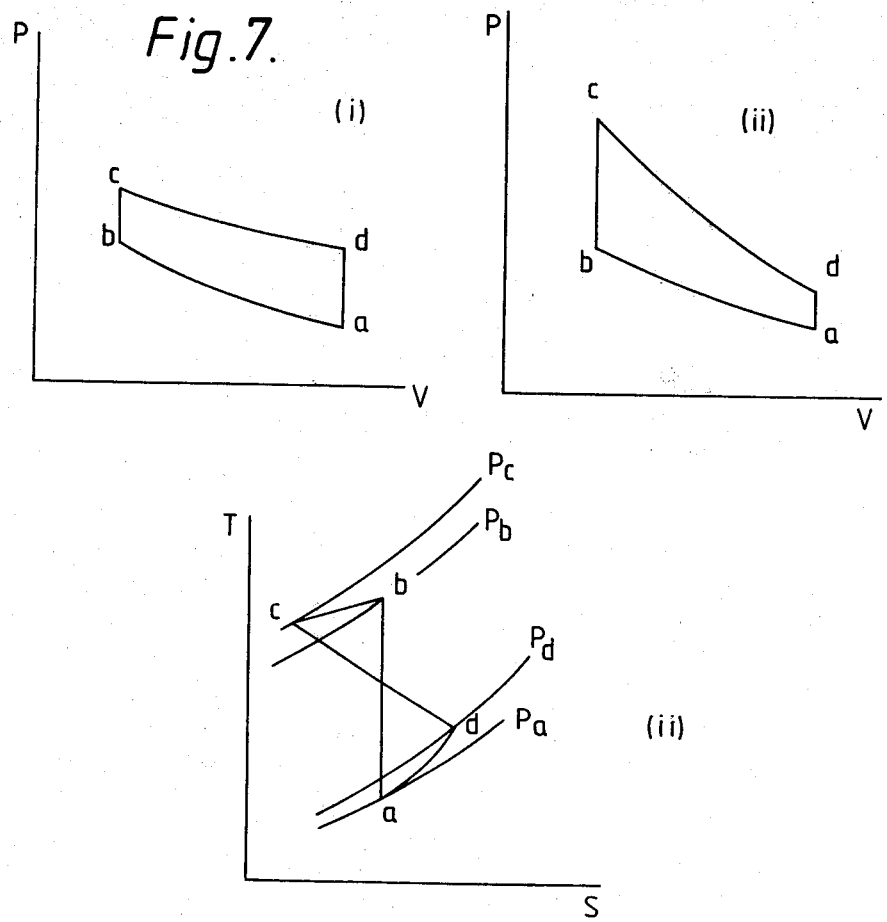
FIG. 7 shows pressure (P) versus volume (V), and temperature (T) versus entropy (S) diagrams for the first embodiment.

Around top dead center, hot pressurized water is injected through a valve and associated injector 51 causing a rapid increase in pressure within the cylinder (along line bc in FIG. 7). The piston then moves back towards bottom dead center, the gas becoming depressurized and cooled in the process. The expansion of the gas in the cylinder is represented by the line cd in FIG. 7. Around bottom dead center the gas is expelled from the cylinder by incoming air and passes to the trap T having a baffle 10. In the trap T, the liquid water is recovered and recycled to the heating coil H wherein it is pressurized and heated. The exhaust air and water vapor is led from the trap via dryer D to the burner where its internal energy is recovered. Any condensate from the dryer is returned via line 7. Any water condensed in the preheater is returned to the pump X via line 9.

Depending on the compression ratio and the rate of working at the time, the temperature of the injected water may be above or equal to the temperature of compressed air in the working space.

Figure 2:
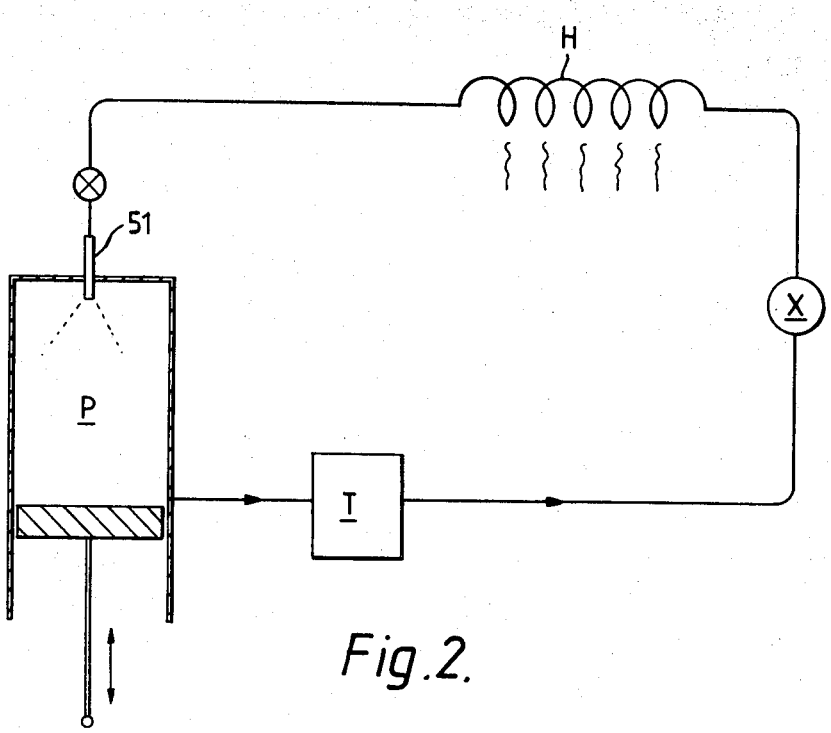
FIG.2 is a simplified view of the first embodiment illustrating its principle of operation.

FIG. 2 emphasizes the fact that the water itself acts principally as a heat transfer fluid which is recycled after use. The only water lost from the system is that carried out in the cooled flue gases from the spray chamber S. The cycle will now be described in more detail.

In a specific embodiment of this invention, heated water at atmospheric pressure and a temperature of below 100° C. is fed from the trap T (and possibly from the spray chamber and preheater) to the pressure pump X whence it is delivered at a high pressure to the heating coil H. The water in the heating coil H is heated to a temperature of around 300° C. and a pressure of around 86 bar. The water is usually heated to temperature below its critical temperature and pressure (220.9 bar and 374° C.), however, because of the orifice provided, the pressure will always be such that at any temperature it will maintain the water in its liquid state.

Ambient air is inducted into the compressor end space C via inlet valve 4 and delivered into the working end space P during the period 45° before to 45° after BDC. This sweeps the spent air from the working end space P and replaces it by cool air. As the piston moves towards TDC again, the air is compressed to around 12 bar and (for a 6:1 compression ratio) to a temperature of around 330° C. at top dead center. Typically, the compression ratio of the cylinder is from 2:1 to 10:1, but, as pointed out earlier, it may be somewhat lower or higher than this range.

At TDC, hot pressurized water at around 86 bar and 300° C. is injected into the working end space P via injector 51 and some water immediately flashes to become vapor, thereby atomizing the remaining injected liquid water and rapidly increasing the pressure in the space P. Water injection is continued for around 5% to 25% of the whole stroke. The pressure reached depends on the amount and temperature of the liquid water injected and on how much of that vaporizes.

The rapid rise in pressure causes the piston 6 to move towards BDC again. Around 45° before BDC the exhaust valve 3 and inlet valve 2 are opened again to discharge wet exhaust gas from the space P. The temperature of the wet exhaust gas is controlled to be low so as to ensure that most of the water vapor in the space P is condensed again to the liquid phase and its latent heat of vaporization recovered. The exhaust air and water droplets are scavenged from the cylinder by the incoming flow of charge air and passed to the trap T where the liquid water is separated from the spent air, before the spent air is fed to the burner. The hot recovered liquid water is then returned to the heat exchanger.

While the present invention has been described using a piston compressor in either the same or a different cylinder from the working end space, it will be appreciated that any other type of compressor may be used, such for example a rotary or separate reciprocating compressor.

Figure 3:
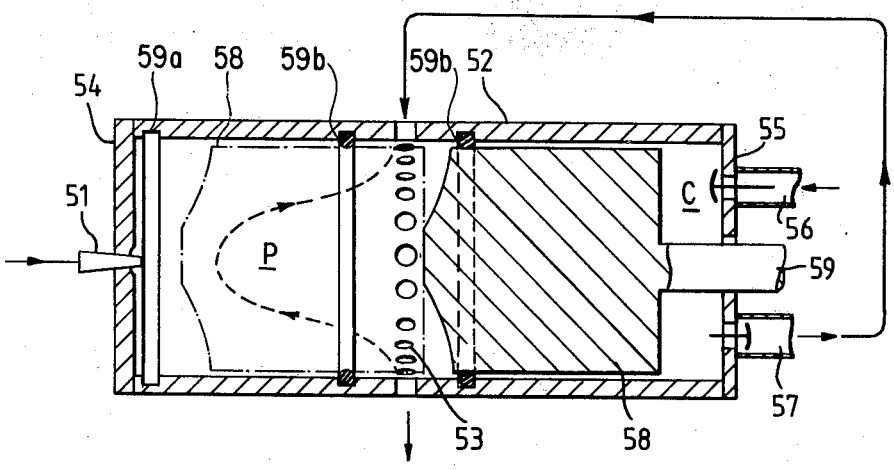
FIG. 3 is a schematic cross-sectional view of the cylinder of the engine.

This embodiment allows a particularly simple cylinder construction, such as the one shown in FIG. 3. The relatively low temperatures encountered allow the use of engineering plastics materials in the construction of the cylinder, and indeed such materials have important low heat conductivity advantages.

The cylinder shown in FIG. 3 comprises a uniflow cylinder body 52 having a row of circumferentially arranged ports 53 which constitute the inlet and outlet to the working end space P of the cylinder. A cylinder head 54 having the water injector 51 mounted therein is attached to one end of the body 52 and an end plate 55 having therein an inlet 56 and outlet 57 (and respective check valves) is provided at the other end of the cylinder. A piston 58 and piston rod 59 are provided within the cylinder. The ports 53 are arranged to be uncovered by the piston 58 as the piston approaches the end of its expansion stroke.

It will be noted that the piston has a contoured upper surface so that the charge air to the working end space P is caused to follow the dotted path through the working end space P and thereby efficiently scavenge the water laden spent air from the space P.

It will be appreciated that the end of the cylinder adjacent the injector 51 is at a relatively high temperature, whereas the end of the cylinder adjacent the inlet and outlet ports 53 is at a relatively low temperature. The use of plastics materials having a low thermal conductivity allows this advantageous temperature differential to be maintained. Thus, were heat to be allowed to be conducted towards the outlet ports 53, the temperature of the spent gas would be raised, thereby resulting in loss of thermal efficiency.

The cylinder schematically represented in FIG. 3 includes a circumferential recess **59*a*** in the cylinder wall for retaining liquid medium in the working space after exhaust.

In addition, as shown in FIG. 3, at least two seals **59*b* are mounted in circumferential recesses in the cylinder wall. The piston of this invention need not fit closely against the cylinder wall, since communication between the working end space and the compressor end space can be blocked by the seals 59*b*, as illustrated by the dotted line view of piston 58, in FIG. 3** which shows the piston at the end of its compression stroke. Having the piston slightly spaced from the cylinder wall provides an advantage in that any scale deposited on the cylinder wall from the water will not interfere with the operation of the engine until a substantial amount has accumulated, and maintenance is thereby reduced.

The external combustion engine according to the invention features good power to weight ratio comparable to internal combustion engines. Although the power to cylinder volume ratio may not be as good, the overall engine power to volume ratio is comparable to that of internal combustion engines. Since it is possible to arrange the combustion conditions in the burner to an optimum, it is possible to achieve almost complete combustion of the fuel to carbon dioxide and water and thus avoid carbon monoxide or unburnt fuel impurities in the exhausted flue gases. In particular, since the combustion occurs substantially at atmospheric pressure, there is practically no generation of nitrogen oxides during the combustion process. Therefore, this engine represents an improvement over internal combustion engines not only in terms of thermal efficiency but also as regard pollutant emissions.

Moreover, the engine is capable of utilizing a wide variety of fuels, for example gasoline, fuel oil, gaseous or liquefied hydrocarbons (including methane, butane and propane), alcohols, and even solid fuels such as wood, coal or coke. The burner parameters may be adjusted to ensure substantially complete and pollution-free combustion. Furthermore, such an engine could be made to run more quietly than conventional internal combustion engines.

Figure 4:
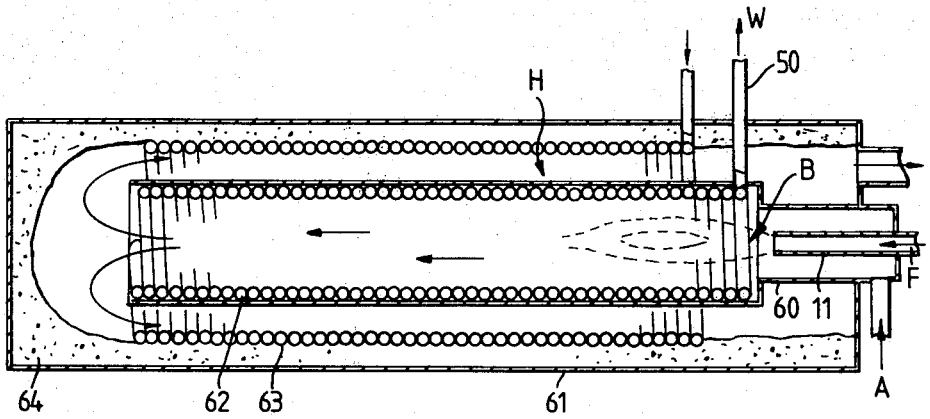
FIG. 4 is a schematic cross-sectional view of a heat exchanger of the engine.

FIG. 4 shows the construction of the heat exchanger which combines the heating coil H and the burner B. The heat exchanger comprises inner and outer coaxial sleeves 60 and 61, respectively, defining a double path for flue gas from the burner. Insulation 64 is provided around the outside of the heat exchanger. A fuel inlet jet is provided for burning fuel F in air A admitted via an air inlet. Water W passes through a heating coil H which comprises an inner coil 62 and outer coil 63 in the direction indicated by the arrows such that water exits from inner coil 62 at a position close to the highest temperature of the burner. The hot pressurized water is then fed along pipe 50 prior to injection into the working space P.

When a multicylinder engine is used, individual cam-operated injector valves may be provided on each cylinder. Alternatively, a distributor may be provided to periodically distribute hot pressurized water to the appropriate cylinder. The injectors may deliver a constant volume of water at a variable temperature. However, injectors delivering a variable volume of water at constant temperature might also be used—particularly when a more rapid change in working rate is required.

Figure 5:
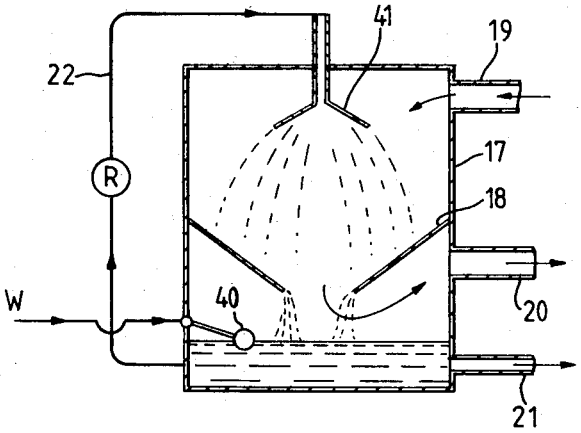
FIG. 5 is a schematic cross-sectional view of a spray device for cooling flue gas from the burner.

FIG. 5 shows a spray device for cooling and washing the flue gases from the burner B and thus recovering some of the heat and some water produced by combustion. It comprises a spray chamber 17 having therein a funnel 18 onto which water is sprayed by spray 42 through the stream of hot flue gases. The flue gases are inducted via inlet 19 and arranged to flow tangentially around the chamber before exiting through the exit 20 as cooled flue gas. The flue gases thus pass through the spray and then through a curtain of water falling from the inside aperture of the funnel 18. Preferably the flue gases are cooled to below 100° C. so as to recover the latent heat of vaporization of water from the burner. Water at substantially 100° exits through the outlet 21 before being fed by pump X into the heat exchanger. Cold feed water W is introduced into the chamber via a ballcock 40 for maintaining a constant level of water in the bottom of the spray chamber. A recycle pump R and associated ducting 22 is provided for recycling the water through the spray to bring it up to its boiling point. However, in practice if it is desired to cool the flue gases below 100° C., it may be necessary to withdraw water through the outlet 21 at a substantially lower temperature, e.g., 50° C.

Figure 6:
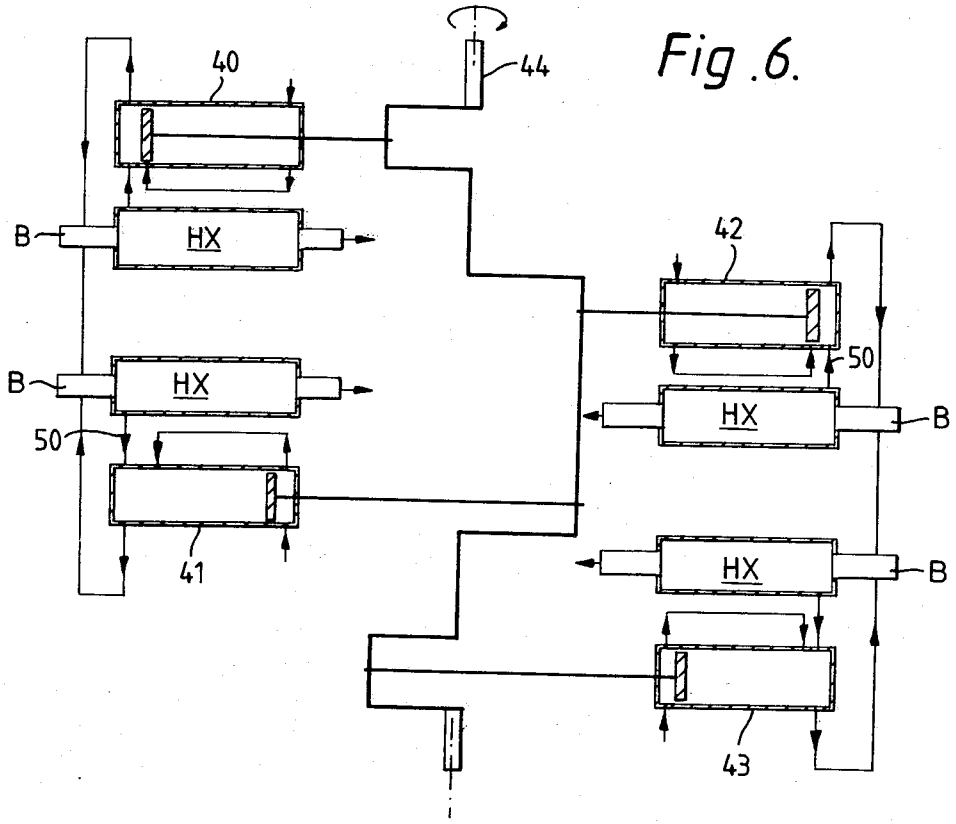
FIG. 6 shows a schematic diagram of a four cylinder arrangement according to the present invention.

FIG. 6 shows one arrangement of four cylinder external combustion engine according to the present invention. The arrangement shown consists of a flat-four arrangement of cylinders 40, 41, 42 and 43. Each cylinder comprises a piston and associated piston rod attached to a common crank shaft 44. It will be noted that each pair of adjacent cylinders is arranged to be 180° out of phase. The arrangement is generally similar to that shown for a single cylinder in FIG. 1, so that certain details are omitted. Each cylinder has its own heat exchanger—burner assembly HX. However, each opposed pair of cylinders 40, 41, and 42, 43 share a common exhaust air feed manifold to the burners so as to damp out fluctuations in the air pressure in the burner.

Figure 8:
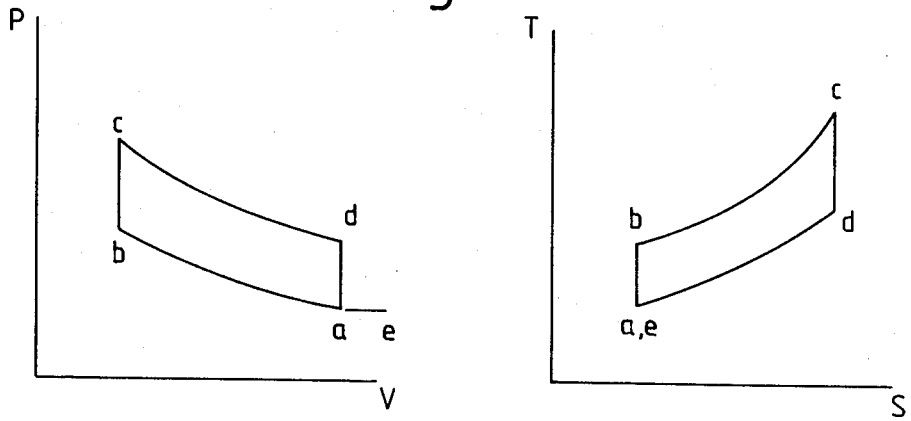
FIG. 8 shows for comparison the PV and TS diagrams for the known two-stroke internal combustion engine.

FIG. 7 shows the idealized thermodynamic operation of the engine of FIG. 1. FIG. 8 shows for comparison the operation of a conventional two-stroke engine.

FIG. 7 (i) is the PV diagram for the case when hardly any of the injected water flashes to vapor, the majority remaining in the liquid phase as droplets. This will occur when the rate of vaporization is slow compared to the stroke time of the piston.

FIG. 7 (ii) is the theoretical PV and TS diagrams for the case when all the injected water vaporizes to the gaseous state. This might occur in a slow working engine.

In FIG. 7 (i) air in the working space P is compressed during the compression stroke adiabatically (i.e., the gas constant is approximately 1.39) along line ab. The compression is also isoentropic and heats the air. At constant volume liquid water is injected and a small amount of water vapor produced at the same temperature as the compressed air so that the pressure increases along bc. Considering only the air in the working space, there is no change in T provided the injected water is at the same temperature. As the piston descends the wet air expands along cd, however, due to the presense of hot liquid water droplets the expansion is not adiabatic but polytropic (typically the gas constant is between 1.33 and 1.35) so that the curve cd on the PV diagram is flattened. The expansion also produces a fall in T and increase in S. The gas is then exhausted from the working space so that the pressure of gas in the working space falls along da.

This replacement of hot pressurized exhaust air by cooler charge air constitutes a fall in both T and S.

FIG. 7 (ii) shows the situation wherein all the water flashes to the vapor state. In this case, the rise in pressure along bc is much greater, but the rate of pressure drop along cd is also quicker since the absence of liquid water droplets ensures that the air expands almost adiabatically. Thus the work done (i.e., the area of the figure abcd) in both cases (i) and (ii) is the same.

Without wishing to be limited by any theoretical discussion, the PV and TS diagrams show the theoretical equilibrium situation when all the injected water is vaporized, i.e., in a slow working engine when less than the amount of water required to saturate the air is injected. For the sake of illustration, the injected water is at a slightly lower temperature than the compressed air in the cylinder.

As before, air is compressed adiabatically (gas constant is about 1.39) along ab at constant entropy. Typically, the pressure $P_a$ at a is 1 bar and the temperature $T_a$ is 300 K. (27° C.). At a compression ratio of 6:1 the air pressure $P_b$ and temperature $T_b$ at b rise to around 12 bar and 603 K. (330° C.).

Liquid water at 573 K. (300° C.) and 86 bar is then injected into the compressed air and all becomes vapor. This causes an increase in pressure along bc (typically $P_c$=25 bar) and a decrease in temperature due to injection of the slightly colder water ($T_c$=586 K. (313° C.)). If the water is at the same temperature as the compressed air the line bc on the TS diagram is horizontal. The reduction in entropy along bc of the air in the cylinder arises from the added partial pressure of the water vapor.

As the piston moves back towards BDC, the wet gas expands (gas constant is about 1.34) along cd to a pressure $P_d$ of about 2 bar and a theoretical temperature $T_d$ of about 319 K. (46° C.). In practice, due to non-theoretical behaviour the temperature will be higher, e.g., 80°-100° C.

The gas is then scavenged from the working space along da as before causing a decrease in temperature, pressure, and entropy of gas in the working space.

In the TS diagram $P_a$ to $P_d$ indicate the constant pressure curves. The net area of the two closed figures in the TS diagram represents the heat added to the air. In the case shown this is negative since injection of the water cools the air. When the water is at the same temperature as the compressed air at b the areas of the two closed figures on the TS diagram cancel out, i.e., no heat is added.

FIG. 8 shows PV and TS diagrams for a known two-stroke cycle internal combustion engine for comparison. It is analogous to the cycle of case (ii) above. The line ae represents the opening of the exhaust valve before the end of the stroke in a conventional two-stroke engine.

Figure 9:
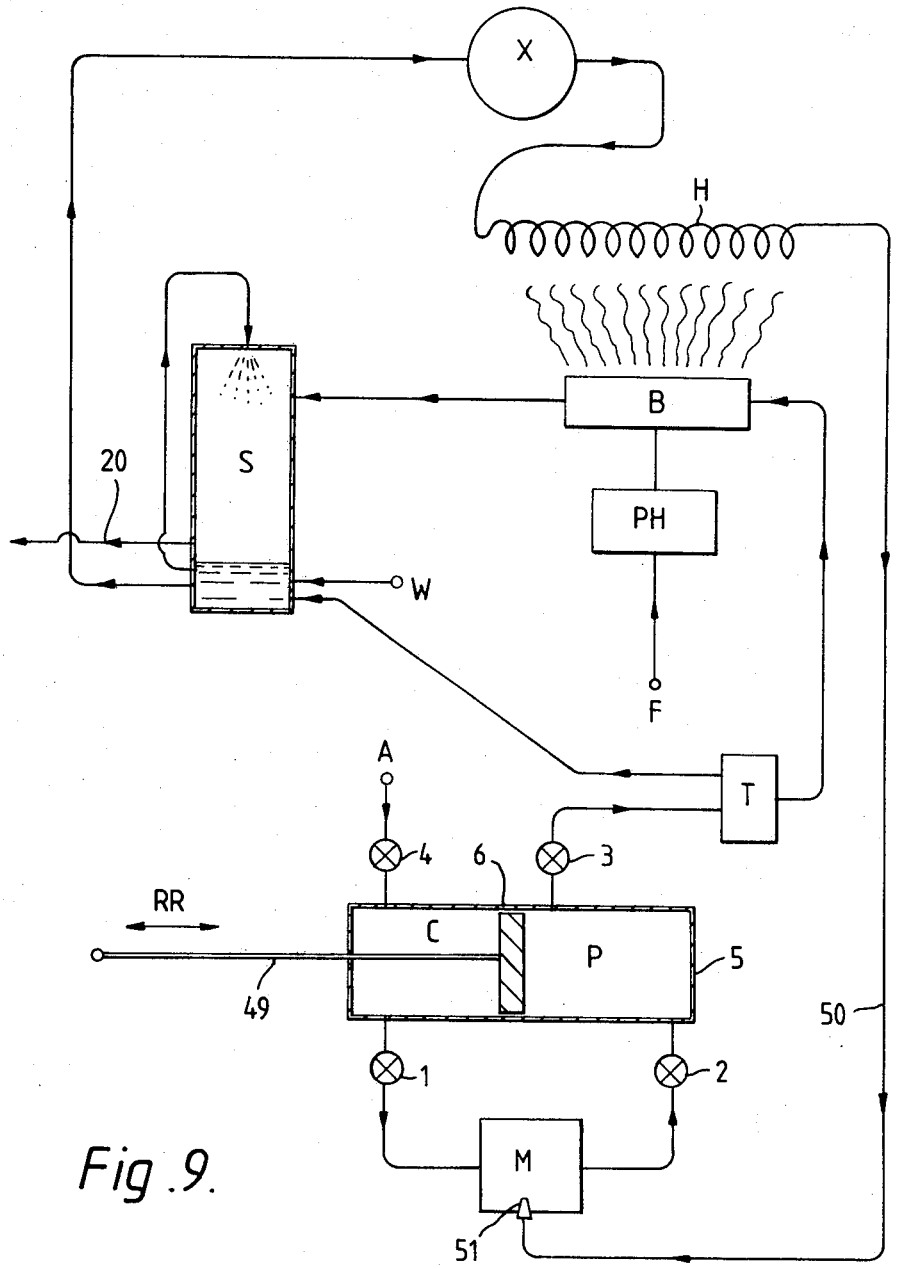
FIG. 9 is a schematic view of a second embodiment of the present invention.

FIG. 9 shows a second embodiment of the present invention which is similar to the embodiment shown in FIG. 1 except that the water passes to a mixing chamber M where the water is injected into the compressed air so as to increase its pressure and temperature. The hot compressed air and water vapor are then passed into the working end space P of the cylinder, as before.

The trap T is provided in order to recover liquid water droplets from the exhaust gas from working end space P. The trap T is of a construction known in steam engine technology for removing liquid water from a gas. Alternatively, the trap may be a cyclone dryer. Water from the trap is returned to the spray chamber S.

Thus, the operation of the engine is as follows. Preheated water from the spray chamber S is fed by means of a high pressure pump X (for example a positive displacement piston pump) to a heating coil H formed of narrow bore tubing. The water is then heated by means of the burner B to a high temperature and pressure, for example 300° C. and 86 bar. The hot pressurized water then passes through pipe 50 to an injection valve 51 in mixing chamber M. The mixing chamber M contains compressed and somewhat heated air which has been delivered from the compressor end space C through the outlet valve 2. When the outlet valve 2 and the inlet valve 1 are closed, hot pressurized water is injected via the injector 51 into the chamber M, thereby raising the temperature and pressure of the air therein. When the piston 6 has reached top dead center, the hot pressurized water vapor—containing air from the mixing chamber M—is admitted through inlet valve 1 into the piston end space P; the outlet valve 3 being closed. The admitted hot pressurized air expands in the cylinder driving the piston 6 towards bottom dead center, the air becoming cooled in the process. As the piston approaches bottom dead center, valve 3 is opened to allow spent air which is still heated and somewhat pressurized to be vented to the burner B.

Figure 10:
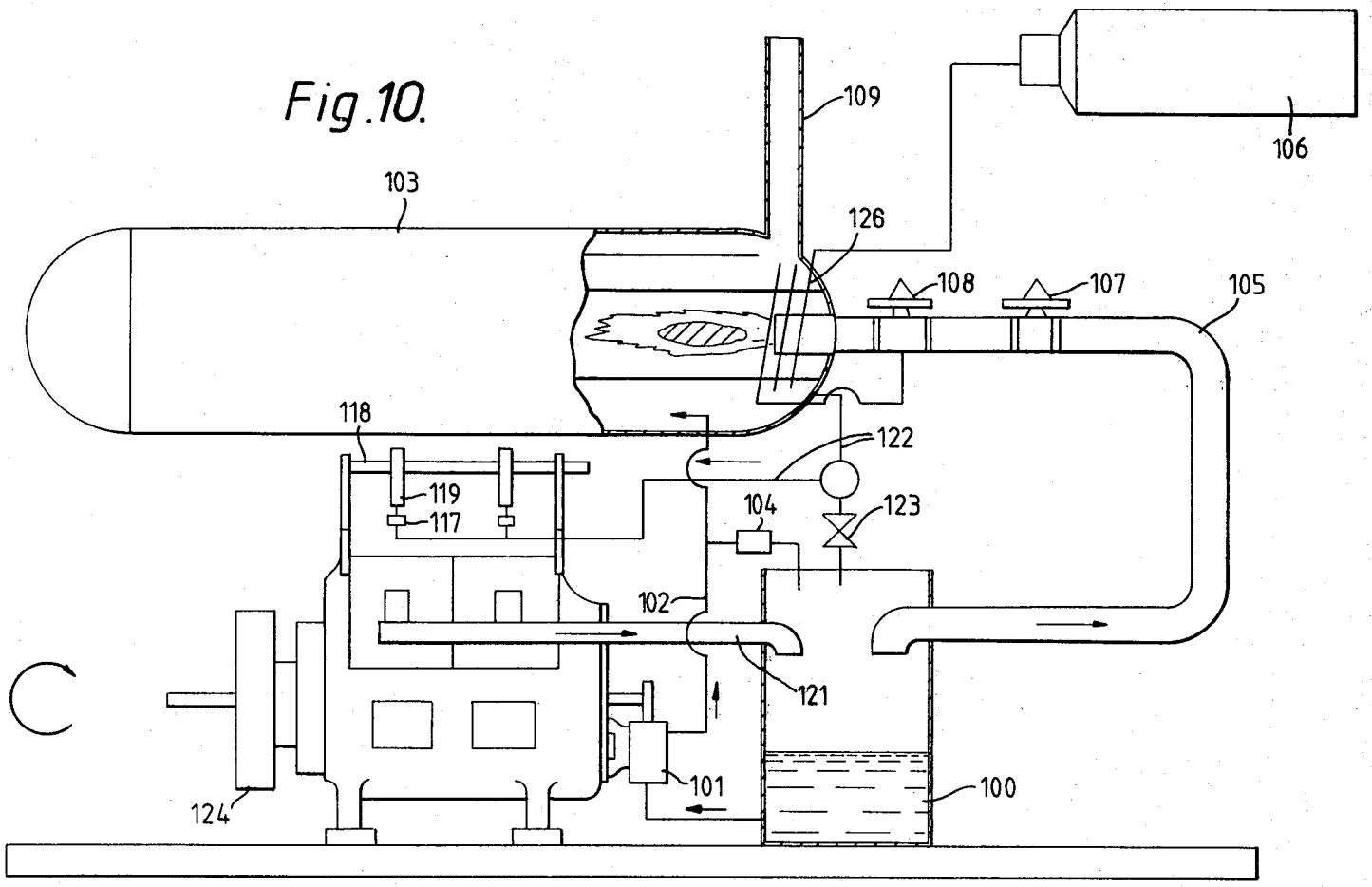
FIG. 10 is a schematic view of a third practical embodiment of the present invention.
Figure 11:
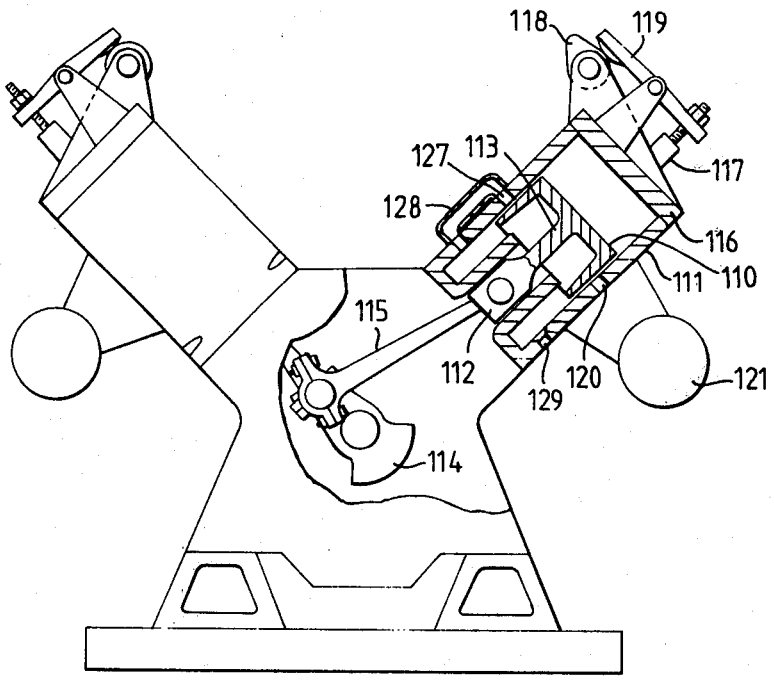
FIG. 11 is a schematic cross-sectional view of the third embodiment.

FIGS. 10 and 11 illustrate a practical form of the invention, which is similar in principle to the embodiment shown schematically in FIG. 1 except that no spray chamber is used.

The engine comprises four cylinders arranged in a 90° V-configuration. Water is pumped from a storage tank 100 by a high pressure pump 101 along a pipe 102 to a two-stage counter flow heat exchanger 103 of a construction as shown in FIG. 4. A pressure relief valve 104 is provided between pipe 102 and trap 100. Exhaust air is directed to the heat exchanger 103 along duct 105 from the trap 100. The air flow is controlled by valve 107. Fuel (e.g., propane gas) is introduced from a canister 106 via a preheater 126 into the air flow through fuel valve 108. Flue gases leave the heat exchanger via flue 109.

Each piston 110 runs in a respective double-acting cylinder 111 and is connected to a crosshead 112 by a piston rod 113. The crosshead is connected to crankshaft 114 by a further rod 115. Each cylinder has a cylinder head 116 provided with an injector 117 which includes a poppet valve operated by a cam on a camshaft 118 by means of a rocker arm 119. The rod end space of the cylinder acts as a compressor, air being inducted via inlet valve 129, and is connected to the inlet 127 of the piston-end space by a pipe 128. Each cylinder also has an exhaust port 120 into common exhaust manifold 121 which returns air and liquid exhaust water to the trap 100. A flywheel 124 is mounted on the crankshaft. The exhaust port shown is controlled by the piston 110 shown in FIG. 11, as in the form of invention shown in FIG. 3, but in either case a valve may be employed for controlling flow through the exhaust or outlet port.

An engine having a 6:1 compression ratio, a 9" diameter piston and a 4" stroke and each cylinder delivers 10 horsepower at a water injection temperature of around 300° C. and a pressure of 86 bar. The inclination of the cylinders assists exhaust of liquid water by gravity. At 300° C. typically about 5 grams of water would be injected per injection. The entire engine is contained within a heat-insulated enclosure.

Hot liquid water leaves the heat exchanger along pipe 122 and is fed to the injector 117. A pressure control valve 123 is provided between pipe 122 and the tank.

It has previously been pointed out that recesses may be provided in the cylinder or piston to retain liquid medium in the working space after exhaust. In FIG. 3 there has been shown a recess **59*a* in the cylinder for this purpose. The engine shown in FIG. 11 has recesses 130** provided in the piston head for this purpose.

The external combustion engine of this invention shown is capable of very high thermal efficiency. Theoretically, cold air A and cold water W (if any) are inducted into the engine, and cold flue gas is vented. Therefore, almost all the heat given out by the burner may become converted into work. In practice, thermal efficiencies of the order of 50 to 60% appear to be attainable.

While it is contemplated that this invention will be carried out by manufacturing new engines incorporating the features disclosed in this invention, it may also be carried out by converting some existing internal combustion engines to operate in accordance with the principles of this invention. For this purpose a kit may be supplied incorporating the necessary components for making such a conversion. Such a kit would include a heat exchanger, including a fuel-air burner, for heating water to the necessary temperature and pressure; an insulated cylinder and piston, the cylinder having an inlet for gas and an outlet for wet exhaust gas; a compressor for inducting gas into the cylinder; a pump for transmitting water from the cylinder to the heat exchanger, an injector for injecting liquid water directly or indirectly under pressure from the heat exchanger into the cylinder, a metering device for controlling the amount of water injected into the cylinder, and a chamber for separating condensed water from dry saturated vapor. The kit could also include, optionally, a mixing chamber for mixing compressed gas with the liquid heat-transfer medium.

It is claimed:

1. A method of operating a reciprocating external combustion engine having a cylinder and a piston therein defining a working end space, wherein energy is transferred to a working gas from a heated vaporizable liquid heat transfer medium, which comprises (1) inducting working gas into the end space;

(2) generating externally of the cylinder heated heat-transfer medium under a pressure such as to maintain the medium in the liquid state;

(3) after induction, injecting heated liquid medium into the working gas and allowing at least part of the liquid medium to vaporize, so as to raise the internal energy of the gas;

(4) in an expansion stroke of the piston, allowing the wet gas containing the heat-transfer medium to expand thereby driving the piston;

(5) exhausting wet gas from the end space near the end of the expansion stroke;

(6) separating liquid heat-transfer medium from wet exhaust gas containing heat-transfer medium vapor; and (7) recycling the separated liquid medium to stage (2) above.

2. A method according to claim 1 wherein the heat transfer medium is selected from the group consisting of water, oil, and mixtures thereof.

3. A method according to claim 1, wherein the working gas is compressed before the heated liquid medium is injected into the gas.

4. A method according to claim 1, wherein the temperature and pressure of the wet exhaust gas are such that substantially all of the heat transfer medium is exhausted in the liquid phase.

5. A method according to claim 1, wherein the working gas is a gas capable of supporting combustion.

6. A method according to claim 5, wherein the heat exchanger comprises a burner and the exhaust gas is fed to the burner for combustion therein.

7. A method according to claim 1, wherein the heated liquid medium has a temperature and a pressure below its critical point but greater than its boiling point at atmospheric pressure.

8. A method according to claim 2, wherein the heat transfer medium is water, the recovered exhaust water is recycled to the engine, heat is supplied to the medium by means of a fuel-air burner, and water is condensed from flue gas from the burner to make up any losses in the recycled water.

9. A reciprocating external combustion engine wherein energy is transferred to a working gas from a heated vaporizable liquid heat-transfer medium, which comprises a cylinder, a piston within the cylinder and reciprocatable therein, a working end space being defined by the cylinder and piston;

a heat exchanger for heating the heat-transfer medium externally of the cylinder under a pressure such as to maintain the medium in the liquid state, the heat exchanger having an inlet for receiving heat-transfer medium and an outlet for delivering heated liquid heat-transfer medium;

induction means connected to the cylinder for inducting gas into the working end space;

an injector connected to the outlet of the heat exchanger and arranged to inject the heated pressurized liquid medium into the gas before expansion of the gas in the working end space, the injector being mounted on the cylinder, whereby at least part of the injected liquid vaporizes on injection;

an outlet from the cylinder which is controlled to exhaust heat transfer medium and working gas from the working end space near the end of an expansion stroke of the piston;

a trap connected to the outlet from the cylinder for recovering liquid heat-transfer medium from wet exhaust gas containing heat-transfer medium vapor; and a high pressure pump connected to feed said medium under pressure in the liquid state to the heat exchanger by recycling from the trap.

10. An engine according to claim 1, and including means for injecting heated liquid medium near the end of a compression stroke of the piston.

11. An engine according to claim 1 wherein the outlet comprises a port in the cylinder wall which is uncovered by the piston as the piston approaches the end of the expansion stroke.

12. An engine according to claim 1, wherein the gas is compressed before the heated liquid medium is injected into the gas.

13. An engine according to claim 12, wherein the cylinder is a double-acting cylinder defining on one side of the piston the working end space and defining on the other side of the piston a compressor end space, the compressor end space having an inlet for working gas and an outlet.

14. An engine according to claim 12 arranged to operate according to a four-stroke cycle, which includes an induction stroke and a compression stroke for the working gas.

15. An engine according to claim 1 wherein the injector is an atomizing injector, which atomizes the injected liquid medium so as to facilitate heat transfer to the gas.

16. An engine according to claim 1, wherein the heat exchanger comprises at least one tube for containing the heat-transfer medium and a fuel burner for heating the medium in said at least one tube under a pressure such as to maintain the medium in the liquid phase.

17. An engine according to claim 16 wherein the working gas is capable of undergoing or supporting combustion, the outlet from the cylinder being connected to the burner for feeding exhaust gas to the burner.

18. An engine according to claim 16 wherein the heat exchanger comprises a tube in the form of an inner coil and an outer coil coaxial therewith, the burner being located within the inner coil such that hot flue gas from the burner passes within the inner coil and then between the inner and outer coils.

19. An engine according to claim 1 wherein the piston and the cylinder are formed at least in part from a heat insulating material selected from the group consisting of plastics, fiber-reinforced resins, wood, concrete, glass and ceramics.

20. An engine according to claim 1 wherein the recycle means comprises a spray chamber having an inlet for heat transfer medium and an inlet for flue gases connected to the heat exchanger, the chamber having a spray for spraying liquid heat-transfer medium through the flue gas from the burner so as to preheat the liquid medium, the chamber further having an outlet connected for feeding heat-transfer medium to the heat exchanger, and an outlet for flue gas.

21. An engine according to claim 1 wherein the injector is a poppet-valve operated by means of a cam.

22. An engine according to claim 1 wherein the cylinder and the piston are so constructed that some liquid medium is retained in the working end space after the exhaust of heat transfer medium.

23. An engine according to claim 22 wherein the cylinder is provided with a recess for retaining liquid medium.

24. An engine according to claim 22 wherein the piston is provided with a recess for retaining liquid medium.

25. A reciprocating external combustion engine wherein heat energy is transferred to air acting as a working gas by means of pressurized liquid water at a temperature greater than the boiling point of water at atmospheric pressure, which comprises a cylinder, a piston within the cylinder and reciprocatable therein, a working end space being defined by the cylinder and piston;

a heat exchanger for heating the liquid water externally of the working space to a temperature above the boiling point of water at atmospheric pressure, the heat exchanger having (1) an inlet for receiving liquid water and an outlet for delivering heated water, (2) at least one tube for containing said liquid water, and a fuel-burner disposed for heating the liquid water in said at least one tube;

pressurizing means connected to said at least one tube of the heat exchanger for maintaining said heated water in the liquid state;

induction means connected to the cylinder for inducting air into the working end space near the beginning of a compression stroke of the piston;

an injector mounted on said cylinder and connected to the outlet of the heat exchanger for receiving heated pressurized liquid water;

control means for controlling the injector to inject said heated pressurized liquid water into the working end space near the end of the compression stroke of the piston, at least part of the liquid water spontaneously vaporizing on injection;

an outlet from the cylinder for exhausting cooled water and air from the working end space near the end of an expansion stroke of the piston, the majority of said cooled water being exhausted in the liquid state; and a trap connected to the outlet from the cylinder for recovering liquid water from wet exhaust gas containing water vapor, and connected to the pressurizing means for recycling liquid water to the heat exchanger.

* * * * *

UNITED STATES PATENT AND TRADEMARK OFFICE

CERTIFICATE OF CORRECTION

PATENT NO. : 4,393,653

DATED : July 19, 1983

INVENTOR(S) : Victor H. Fischer

It is certified that error appears in the above-identified patent and that said Letters Patent is hereby corrected as shown below:

Column 1, line 23, "theproblem" should be --the problem--.

Column 2, line 36, "stage" should be --state--.

Column 3, line 51, "stage" should be --state--.

Column 4, line 64, "gasses" should be --gases--.

Column 5, line 19, after the word "of" insert --a--.

In the Claims:

Columns 14 and 15, Claims 10, 11, 12, 15, 16, 19, 20, 21, and 22, line 1 of each, change "1" to --9--.

UNITED STATES PATENT AND TRADEMARK OFFICE

CERTIFICATE OF CORRECTION

PATENT NO. : 4,393,653

DATED : July 19, 1983

INVENTOR(S) : Victor H. Fischer

It is certified that error appears in the above-identified patent and that said Letters Patent is hereby corrected as shown below:

Column 4, line 38, change "has" to --as--.

Column 9, line 11, change "regard" to --regards--.

In the Drawings:

In Fig. 9, the numeral "2" should be --1-- and the numeral "1" should be --2--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*